US011357363B2

(12) United States Patent
Wong

(10) Patent No.: US 11,357,363 B2
(45) Date of Patent: Jun. 14, 2022

(54) HAND SOAP DISPENSER WITH TIMER

(71) Applicant: Betty Ko Wong, Seattle, WA (US)

(72) Inventor: Betty Ko Wong, Seattle, WA (US)

( * ) Notice: Subject to any disclaimer, the term of this patent is extended or adjusted under 35 U.S.C. 154(b) by 0 days.

(21) Appl. No.: 17/239,588

(22) Filed: Apr. 24, 2021

(65) Prior Publication Data

US 2021/0330136 A1 Oct. 28, 2021

Related U.S. Application Data

(60) Provisional application No. 63/015,550, filed on Apr. 25, 2020.

(51) Int. Cl.
*A47K 5/12* (2006.01)
*G08B 21/24* (2006.01)

(52) U.S. Cl.
CPC ..... *A47K 5/1205* (2013.01); *G08B 21/245* (2013.01)

(58) Field of Classification Search
CPC ..... A47K 5/1205; G08B 21/245
See application file for complete search history.

(56) References Cited

U.S. PATENT DOCUMENTS

| | | | | |
|---|---|---|---|---|
| 3,194,434 | A * | 7/1965 | Evanson | G01F 11/284 222/1 |
| 3,240,007 | A * | 3/1966 | Dock | G04F 1/08 368/93 |
| 4,054,026 | A * | 10/1977 | Goodrich | G04F 1/08 368/93 |
| 5,457,665 | A * | 10/1995 | Reid | G04F 1/08 368/93 |
| 6,832,916 | B2 * | 12/2004 | Collopy | G09B 19/0076 222/321.9 |
| 9,259,751 | B2 * | 2/2016 | Crawford | B05B 11/0089 |
| 10,698,368 | B2 * | 6/2020 | Briggs | G01F 11/006 |
| 2014/0175122 | A1 * | 6/2014 | Crawford | B05B 11/0037 222/78 |
| 2021/0330136 | A1 * | 10/2021 | Wong | A47K 5/1205 |

* cited by examiner

*Primary Examiner* — Vishal Pancholi
*Assistant Examiner* — Bob Zadeh

(57) ABSTRACT

A liquid soap dispensing device with a soap dispensing apparatus and a timer, and associated methods, are disclosed herein. The soap dispensing apparatus includes a housing and a soap dispensing element. The timer includes a traveling object (e.g., a ball), a track, and a mover. The track is configured to receive the traveling object at a start position and release the traveling object at an end position. The track is also configured to carry the traveling object from the start position to the end position in a time interval. The mover is configured to displace the traveling object from a first position to a second position. Displacement of the traveling object from the first position to the second position initiates the release of the traveling object onto the track at the start position.

20 Claims, 9 Drawing Sheets

HAND SOAP DISPENSER WITH TIMER

This application claims the benefit of U.S. Provisional Patent Application Ser. No. 63/015,550 filed Apr. 25, 2020, which is incorporated by reference herein.

TECHNICAL FIELD

The present technology generally relates to soap dispensers and, in particular, a new soap dispensing device integrated with a timer to promote hygiene and facilitate effective hand washing.

BACKGROUND

Washing hands properly is important for promoting hygiene, reducing risk of infection, and preventing disease. One method that the Centers for Disease Control and Prevention (CDC) recommends for mitigating the risk of infections from viruses, such as Severe Acute Respiratory Syndrome Coronavirus 2 (SARS-CoV-2) which causes a respiratory disease called coronavirus disease 19 (COVID-19), is to properly wash hands. Proper hand-washing techniques as recommended by the CDC include lathering and scrubbing hands with soap for at least 20 seconds. However, many people, including both children and adults, may find washing their hands for the recommended duration difficult. For example, they may feel that 20 seconds is too long. Subsequently, they may curtail the amount of time they lather and scrub their hands. Conventional methods for promoting hand washing for the recommended duration includes counting to 20 or singing a song that spans the recommended duration. However, these conventional methods require additional work (e.g., mental work) for a user who may already perceive the hand-washing process as laborious. Accordingly, a need exists to better promote compliance with proper hand-washing techniques, particularly washing hands for the recommended duration.

BRIEF DESCRIPTION OF THE DRAWINGS

Many aspects of the present technology can be better understood with reference to the following drawings. The components in the drawings are not necessarily to scale. Instead, emphasis is placed on illustrating clearly the principles of the present technology.

DETAILED DESCRIPTION

Figure 1A:
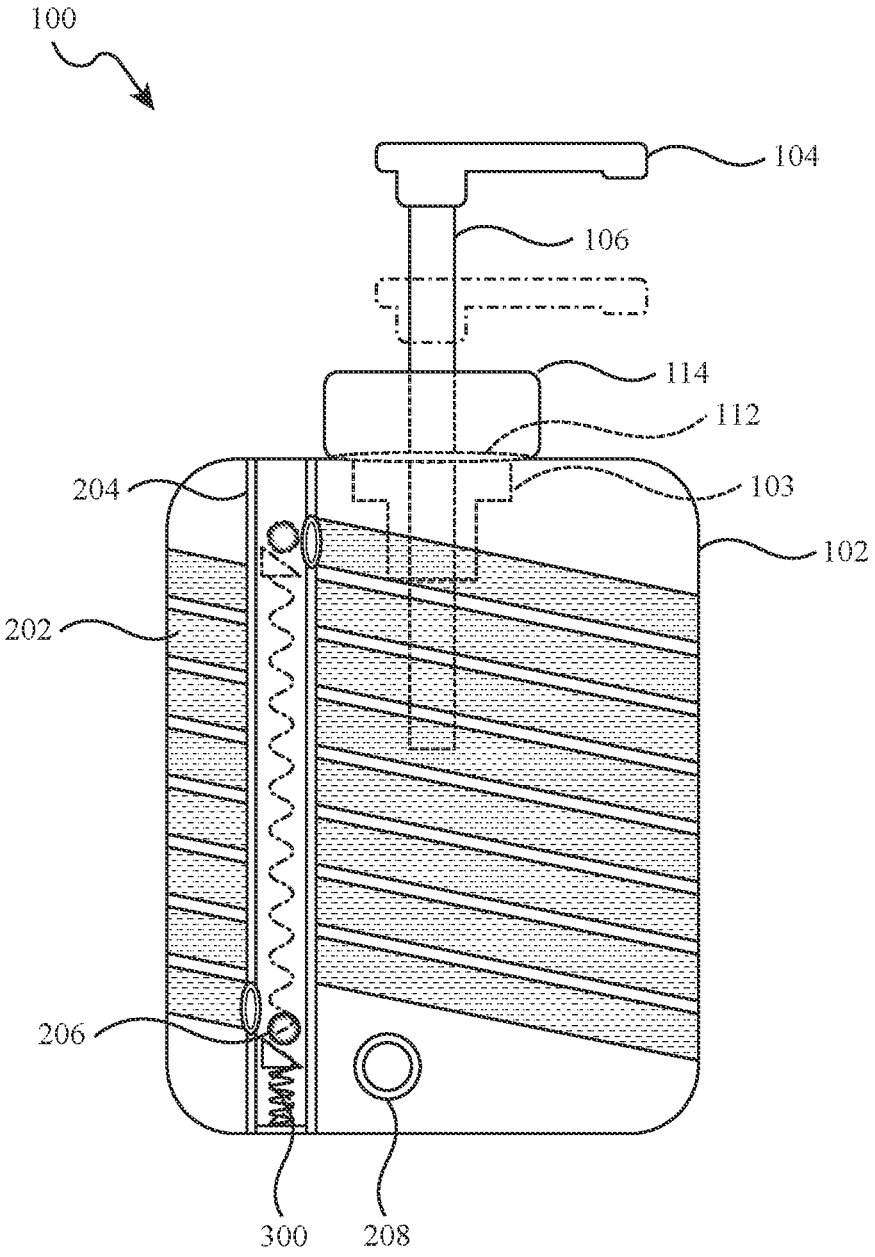
FIGS. 1A and 1B is a front perspective view and cross-sectional view, respectively, of a liquid hand soap dispenser configured in accordance with select embodiments of the present technology.

The present technology is directed to a soap dispenser for use during hand washing. The soap dispenser includes a soap dispensing apparatus (e.g., for dispensing liquid and/or foam soap) and a "rolling ball timer" (herein also referred to as "timer"). The timer allows a user to know when a predetermined duration or time interval (e.g., 20 seconds) has passed. The soap dispensing apparatus may be coupled to the timer. For example, actuating a manual soap dispensing apparatus, such as by the user pressing a pump head of the soap dispensing apparatus, can activate the timer. In another example, actuating an automatic soap dispensing apparatus, such as by the user placing their hands in proximity of a sensor of the dispenser, can activate the timer.

In certain embodiments, the timer comprises a traveling object that travels (e.g., moves, rolls, and slides) along a track. For example, the timer can include a ball that rolls through a tube. The timer is configured such that the traveling object (e.g., a ball) travels along the track for the predetermined duration (e.g., time interval). For example, the predetermined duration can be 20 seconds or 30 seconds. The track can be configured to have a slope, a length, and a surface characteristic (e.g., smooth, rough, and/or bumpy) such that the traveling object moves along the track via gravity from a starting point of the track to an end point of the track for approximately the predetermined duration.

The timer can include any suitable visual, audio, and/or vibratory signal(s) to indicate to the user a passage of the predetermined duration. For example, the traveling object may be opaque and/or colored and the timer includes a transparent enclosure. In this example, the user can visually watch the traveling object move through and reach the end of the track. The timer may transmit any suitable visual, audio, and/or vibratory signals. For example, the timer may transmit a light, such as light emitted from an LED, when the predetermined duration is reached (e.g., the traveling object reaches the end position of the track). In yet another example, the audio signal can include a sound. The sound can include any suitable noise, such as a chime, ring, ding, etc. In a further example, the audio signal can include a voice message (e.g., "Time's Up" and/or "You're done").

The present technology and methods may be advantageous over existing methods for promoting compliance with proper hand-washing techniques because the present technology requires less steps for the user to follow compared to other methods (e.g., counting and singing a song). A benefit of the present technology includes alleviating the negative feelings related to the hand-washing process for the user. Another benefit of the present technology includes promoting reward-based training of the user to comply with proper hand-washing techniques. For example, the visual, audio, and/or vibratory signal transmitted after the passage of the target duration may produce a positive feedback to the user and therefore encourage the user to wash their hands for approximately the target duration. In a further example, visualization of the traveling object (e.g., a rolling ball), as described herein, may alleviate the user's perception of time and enhance the experience during the hand-washing process.

The terminology used in the description presented below is intended to be interpreted in its broadest reasonable manner even though it is being used in conjunction with a detailed description of certain specific embodiments of the present technology. Certain terms may even be emphasized below; however, any terminology intended to be interpreted in any restricted manner will be overtly and specifically defined as such in this Detailed Description section. Additionally, the present technology can include other embodiments that are within the scope of the examples but are not described in detail with respect to FIGS. 1A-6.

Reference throughout this specification to "one embodiment" or "an embodiment" means that a particular feature, structure, or characteristic described in connection with the embodiment is included in at least one embodiment of the present technology. Thus, the appearances of the phrases "in one embodiment" or "in an embodiment" in various places throughout this specification are not necessarily all referring to the same embodiment. Furthermore, the particular features or characteristics may be combined in any suitable manner in one or more embodiments.

Reference throughout the specification to relative terms such as, for example, "generally," "approximately," and "about" are used herein to mean the stated value plus or minus 10%. In instances in which relative terminology is used in reference to something that does not include a numerical value, the terms are given their ordinary meaning to one skilled in the art.

For ease of reference, identical reference numbers are used to identify similar or analogous components or features throughout this disclosure, but the use of the same reference number does not imply that the features should be construed to be identical. Indeed, in many examples described herein, identically numbered features have a plurality of embodiments that are distinct in structure and/or function from each other. Furthermore, the same shading may be used to indicate materials in cross section that can be compositionally similar, but the use of the same shading does not imply that the materials should be construed to be identical unless specifically noted herein.

Figure 1B:
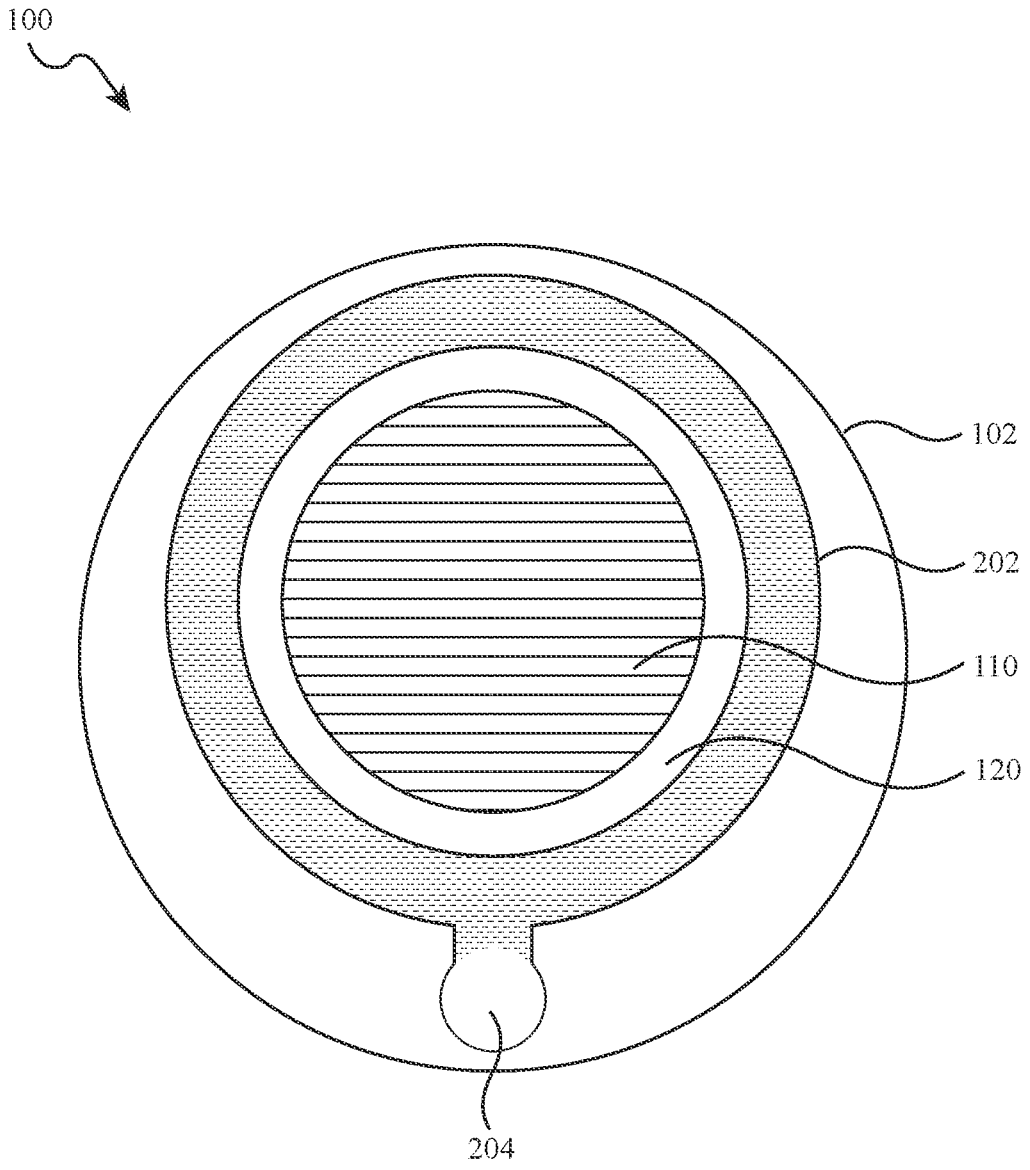

FIG. 1A is a front perspective view of a hand soap dispenser 10 ("dispenser 10") and FIG. 1B is a cross-sectional view of the dispenser 10, illustrating the internal construction of the dispenser 10, configured in accordance with select embodiments of the present technology. Referring to FIGS. 1A and 1B together, the dispenser 10 includes a soap dispensing apparatus 100 ("apparatus 100") and a timer 200. The soap dispensing apparatus 100 can include an external housing 102, a pump 103, a pump head 104 coupled to the pump 103, a closure 114, a soap reservoir 110, a first reservoir opening 112, a hollow plunger 106 extending from the soap reservoir 110 to the pump head 104, and an internal housing 120. The timer 200 can include a first track 202, a second track 204, a traveling object 206, and a mover 300. In some embodiments, the timer 200 includes an indicator 208.

The apparatus 100 can include additional components generally similar to or the same as components in conventional liquid hand soap dispensers, such as a gasket, dip tube, and interior components (e.g., a spring, ball, piston, and/or stem). The apparatus 100 may be manufactured by processes used in manufacturing conventional liquid hand soap dispensers. In some embodiments, the manufacturing process of the apparatus 100 can include 3D printing. The external housing 102, pump 103, and pump head 104 can include features and components generally similar to or the same as housing, pumps, and pump heads, respectively, of conventional liquid hand soap dispensers. As with conventional liquid hand soap dispensers, the pump head 104 can be displaced from a first pump head position (illustrated as a solid line) to a second pump head position (illustrated as a dashed line) via pressure applied by the user. While FIG. 1A illustrates the apparatus 100 having the pump head 104, the apparatus 100 can have any suitable component to dispense liquid soap. For example, the apparatus 100 may not include a pump head 104. The apparatus 100 may include a valve, a lever, and/or other suitable components.

The external housing 102 (e.g., container) can encase any suitable number of and/or portion of components of the apparatus 100. In some embodiments, the external housing 102 encases the pump 103, the soap reservoir 110, the internal housing 120, and/or the timer 200. In some embodiments, the external housing 102 encases at least a portion of the pump 103, at least a portion of the soap reservoir 110, at least a portion of the internal housing 120, and/or at least a portion of the timer 200. The internal housing 120 includes the soap reservoir 110. The soap reservoir 110 can receive liquid (e.g., liquid soap) via the first reservoir opening 112. The first reservoir opening 112 can receive the closure 114. The closure 114 is configured to form a seal to the soap reservoir 110. For example, the closure 114 can be configured to form a seal to the soap reservoir 110 between the external housing 102, the pump 103, and the pump head 104. In another example, the closure 114 can be configured to form a seal to the soap reservoir 110 between the internal housing 120, the pump 103, and the pump head 104. In some embodiments, the closure 114 is configured to be removable. In other embodiments, the closure 114 is configured to be fixed (e.g., not removable). While FIGS. 1A and 1B illustrate the apparatus 100 having an external housing 102 and internal housing 120, the apparatus 100 may include only the external housing 102 or only the internal housing 120.

The external housing 102 may be fabricated of any suitable materials. In some embodiments, the external housing 102 is fabricated of any suitable rigid material such as metal, hard plastic (e.g., high-density polyethylene), and/or glass. In some embodiments, the external housing 102 is fabricated of any suitable flexible material such as flexible plastic (e.g., low density polyethylene). In some embodiments, the external housing 102 is transparent. For example, the external housing 102 is made of transparent glass or transparent plastic. In some embodiments, at least a portion of the external housing 102 is transparent. For example, a portion of the external housing 102 is transparent to visually expose at least a portion of the timer 200. In some embodiments, the external housing 102 includes a viewing window (e.g., an opening) that physically and/or visually exposes at least a portion of the timer 200.

In some embodiments, the apparatus 100 can include access to the soap reservoir in addition to or in lieu of the first reservoir opening 112. For example, the apparatus 100 can include a second reservoir opening (not illustrated) and a second reservoir cap configured to seal the second reservoir opening. The second reservoir opening can provide access to the soap reservoir 110. For example, the second reservoir opening can provide the user access to the soap reservoir 110 without needing to remove the closure 114. The second reservoir opening can be located away from the first reservoir opening 112. For example, the second reservoir opening can be located on a bottom side of the apparatus 100. In another example, the second reservoir opening can be located on a top side of the apparatus 100.

Referring to FIG. 1B, while the cross section of the external housing 102 and internal housing 120 are shown to be approximately circular in FIG. 1B, the external housing 102 and internal housing 120 can have other cross-sectional shapes (e.g., elliptical, oval, oblong, rectilinear, rectangular, square, irregular, diamond, trapezoidal, or any combination thereof).

Referring to FIG. 1A, in some embodiments, the first track 202 of the timer 200 is configured with a downwardlyinclined, spiral layout. Referring to FIG. 1B, the first track 202 wraps around the outer perimeter of the internal housing 120. In some embodiments, the first track 202 can wrap around the outer perimeter of the external housing 102. In other embodiments, at least a portion of the first track 202 can wrap around the internal housing 120 and/or external housing 102 and/or may extend through the soap reservoir 110. While FIG. 1A illustrates the first track 202 configured with a spiral layout, the first tracks 202 can be configured with other suitable layouts. For example, other suitable layouts include serpentine, irregular, or any combination thereof.

While FIGS. 1A and 1B illustrate the apparatus 100 having features and components similar to or the same as a conventional manual hand soap dispenser, the apparatus 100 can have features and components similar to the same as a conventional automatic hand soap dispenser. For example, the apparatus 100 may include an infrared sensor, which is generally a component of automatic liquid and/or foaming hand soap dispensers. In some embodiments, the same infrared sensor for activating the dispensing of soap may be used to activate the timer 200 (see FIG. 2B).

Figure 2A:
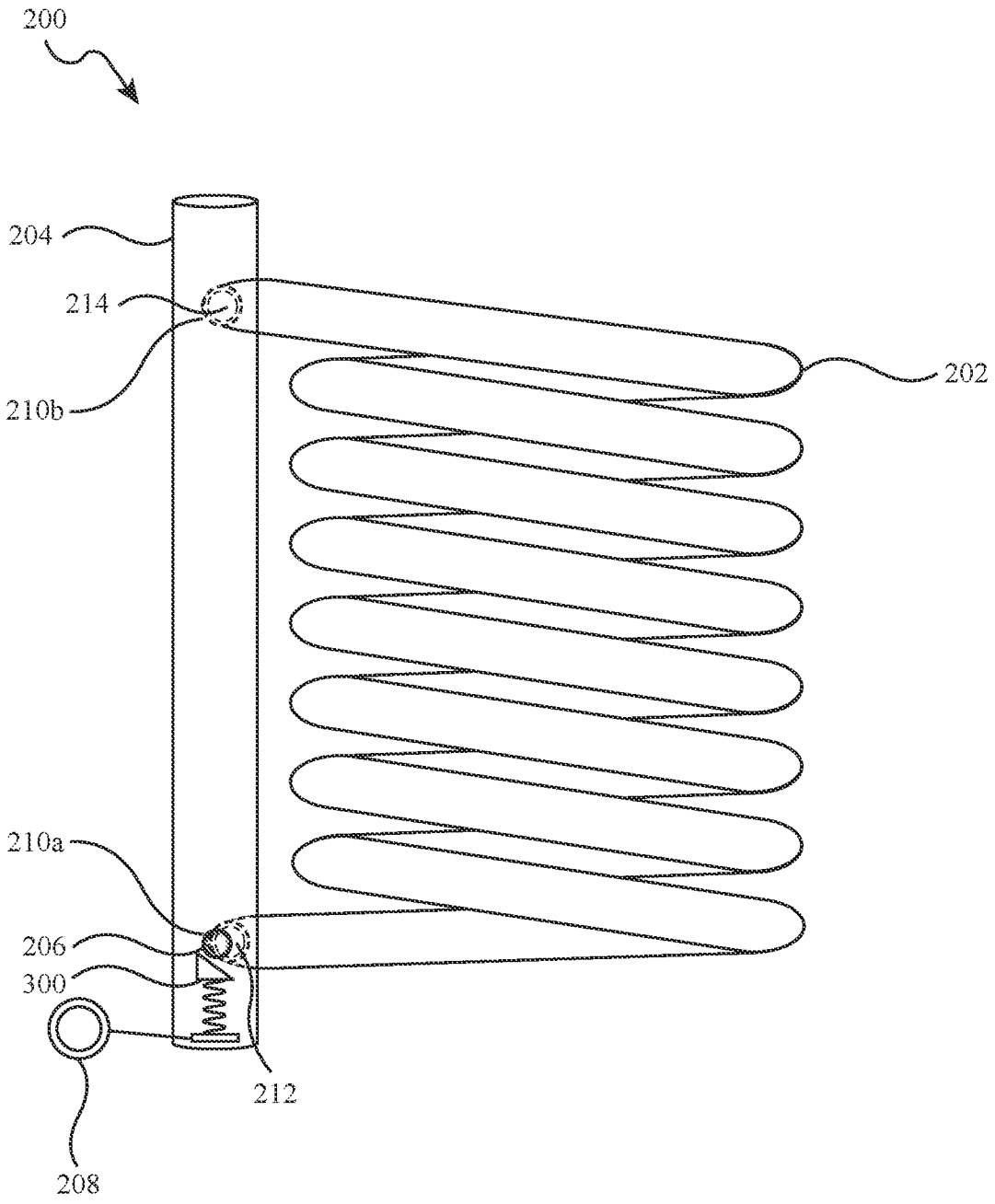
FIGS. 2A and 2B are isometric views of a rolling ball timer of the liquid hand soap dispenser configured in accordance with the present technology.

FIG. 2A is an isometric view of the timer 200 configured in accordance with the present technology. The timer 200 can be activated via any suitable mechanical, electrical, and/or magnetic means. The timer 200 includes the first track 202 and the second track 204 having a path connected to a path of the first track 202. The mover 300 and the traveling object 206 may be located at a first mover position 210*a* (illustrated as solid lines in FIG. 1A) in a resting (e.g., stationary) state. Upon activation of the timer 200, the mover 300 can move from the first mover position 210*a* to a second mover position 210*b* (illustrated as dashed lines in FIG. 1A) along the second track 204. In some embodiments, the mover 300 moves in an approximately vertically upward direction. During operation, the mover 300 can carry the traveling object 206 from the first mover position 210*a* to the second mover position 210*b*. At the second mover position 210*b*, the mover 300 can release the traveling object 206 onto the first track 202. The mover 300 can return to the first mover position prior to the traveling object 206 reaching the end of the first track 202. The mover 300 can receive the traveling object 206 upon the traveling object 206 exiting the first track 202. In some embodiments, the indicator 208 transmits a signal when the traveling object 206 exits the first track 202.

The resting state of the mover 300 and/or the traveling object 206 can be any suitable location along the second track 204. In some embodiments, the resting state of the mover 300 and/or the traveling object 206 is located proximate to the first mover position 210*a*. In some embodiments, the resting state of the mover 300 and/or the traveling object 206 is located proximate to the second mover position 210*b*. In some embodiments, the resting state of the mover 300 and/or the traveling object 206 is located between the first mover position 210*a* and the second mover position 210*b*.

The first track 202 and the second track 204 can include paths that are connected to each other. For example, the first track 202 and the second track 204 may have a continuous path connected via a top opening 214 and a bottom opening 212. In another example, the first track 202 may have a path that is discontinuous from the second track 204, but during operation, the traveling object 206 can travel continuously from the first track 202 to the second track 204 and vice versa. Upon entering the first track 202 via the top opening 214, the traveling object 206 may move (e.g., roll and slide) along the first track 202 via gravity. Upon exiting the first track 202 via the bottom opening 212, the traveling object 206 may return to a resting state on the mover 300.

The second track 204 can be formed of any suitable structure for the mover 300 and the traveling object 206 to move along in an approximately upward vertical direction. In some embodiments, the second track 204 includes a tube. In some embodiments, the second track 204 includes three or more rails.

The first track 202 can be configured for the traveling object 206 to move along the first track 206 for a target duration (e.g., time interval). For example, the first track 202 is configured for the traveling object 206 to move from the top opening 214 through the first track 202 to the bottom opening 212 for the target duration. The target duration can be any suitable amount of time. In some embodiments, the target duration can be within a range of approximately 15 to 40 seconds. The target duration can be approximately 15, 20, 30, 40 seconds, or any suitable number of seconds. In some embodiments, the target duration is less than 15 seconds. In some embodiments, the target duration is greater than 40 seconds.

The first track 202 can be configured based on a plurality of properties including, but not limited to, a material, incline/slope, length, cross-sectional shape and size, and/or surface properties. The first track 202 can be fabricated of any suitable materials. In some embodiments, the tube 202 is fabricated of any suitable rigid material such as metal, hard plastic (e.g., high-density polyethylene), and/or glass. In some embodiments, the tube 202 is fabricated of any suitable flexible material such as flexible plastic (e.g., low density polyethylene) and/or rubber. The material of the tube 202 can be selected based on a coefficient of friction (COF) of the material to adjust the speed of the ball 206 traveling through the tube 202 during operation. In some embodiments, the tube 202 is fabricated of transparent material. During operation, the user can therefore see the traveling object 206 travel along the first track 202.

In some embodiments, the first track 202 is configured with a downward pattern. The first track 202 may include a steeper or shallower incline (e.g., slope) to adjust the speed of the traveling object 206 traveling through the first track 202 during operation. For example, the incline can include angles within a range of 1 to 45 degrees. In another example, the incline can include angles greater than 45 degrees and less than 90 degrees.

The first track 202 can have any suitable path length. In some embodiments, the path length of the first track 202 can be within the range of 20 to 50 centimeters (cm). In other embodiments, the path length of the first track 202 can be less than 20 cm. In other embodiments, the path length of the first track 202 can be greater than 50 cm.

The first track 202 can include any suitable structure and/or shape to carry the traveling object 206. In some embodiments, the first track 202 includes a tube (e.g., a hollow cylinder). In some embodiments, the first track 202 includes a curved and/or edged structure. For example, the first track 202 can include a half cylinder. In another example, the first track 202 can include two or more rails. The first track 202 can have cross-sectional shapes including circular, elliptical, oval, oblong, rectilinear, rectangular, square, irregular, diamond, trapezoidal, or any combination thereof.

The first track 202 can have any suitable surface properties. For example, the first track 202 can have a smooth surface, a rough surface, or a combination thereof (e.g., patches of smooth and rough surfaces) throughout the entirety of the first track 202. In some embodiments, the first track 202 can include ridges, bumps, and/or potholes.

In some embodiments, the cross-sectional shape and size throughout the length of the first track 202 is approximately uniform. In some embodiments, the cross-sectional size and shape throughout the length of the first track 202 vary. For example, a first portion of the first track 202 proximate to the top opening 214 may have a cross-sectional size greater than the size of the cross-sectional size of the traveling object 206 and greater than the cross-sectional size of other portions of the first track 202.

In some embodiments, the first track 202 has a cross-sectional width or diameter that is greater than a cross-sectional width or diameter of the traveling object 206. For example, the cross-sectional width or diameter of the first track 202 can be 110%, 120%, 140%, 160%, 180%, 200%, or greater than 200% of the cross-sectional width or diameter of the traveling object 206. In some embodiments, the first track 202 has a cross-sectional width or diameter that is equal to the cross-sectional width or diameter of the traveling object 206. For example, the cross-sectional width or diameter of the first track 202 can be approximately 100% of the cross-sectional width or diameter of the traveling object 206. In some embodiments, the first track 202 has a cross-sectional width or diameter that is less than a cross-sectional width or diameter of the traveling object 206. For example, the cross-sectional width or diameter of the first track 202 can be 20%, 40%, 60%, 80%, or less than 100% of the cross-sectional width or diameter of the traveling object 206.

The traveling object 206 can be any suitable object with properties suitable for moving. The traveling object 206 can be a ball, a block, a wheel, and/or any other suitable object that may roll, glide, tumble, turn, etc. The traveling object 206 can be configured based on a plurality of properties including, but not limited to, a material, cross-sectional shape and size, and/or surface properties.

The traveling object 206 can be made of any suitable materials. The traveling object 206 may be fabricated of any suitable rigid material such as plastic, glass, metal, wood, rubber, or any combination thereof. The material of the traveling object 206 may be selected based on a COF and/or density of the material to adjust the speed of the traveling object 206 traveling along the first track 202 during operation. In some embodiments, the cross-sectional size of the traveling object 206 can include a diameter in the range of about 1 to 10 millimeters (mm). For example, the diameter can be approximately 1, 2, 3, 4, 5, 6, 7, 8, 9, or 10 mm. In other embodiments, the diameter can be less than 1 mm. In other embodiments, the diameter can be greater than 10 mm. In some embodiments, the traveling object 206 can include an LED (not illustrated). The LED of the traveling object 206 can be motion activated. For example, the LED emits a light when the traveling object 206 is in motion.

The indicator 208 can transmit a signal to the user to indicate that the target duration (e.g., 20 seconds) has been reached. The indicator 208 can include one or more visual, audio, and/or vibratory signals. In some embodiments, the indicator 208 can include, but not limited to, a light, LED, bell, speaker, vibratory device, or any combination thereof. The visual signal can include a visible light. The audio signal can include a chime, ring, ding, and/or voice recording. In some embodiments, the indicator 208 can transmit the signal to the user to indicate that the timer 200 has started. In some embodiments, the indicator 208 can transmit the signal to the user periodically or continuously throughout the target duration of the timer 200. In some embodiments, the indicator 208 may be turned on and/or off. For example, the indicator 208 may include a switch and/or a button to allow the user to turn the indicator on or off. In some embodiments, the timer 200 may not include the indicator 208.

In some embodiments, the timer 200 can include one or more indicators 208. For example, the timer 200 can include a first indicator and a second indicator. The first indicator can transmit a first signal at the start of the target duration. The second indicator can transmit a second signal at the end of the target duration. The first indicator may be the same as or different than the second indicator. The first signal may be the same as or different than the second signal. For example, the first indicator may be an LED transmitting light, and the second indicator may be a bell transmitting a chime. In some embodiments, the timer 200 can include a third indicator. The third indicator can transmit a first signal between the start and end of the target duration. For example, the third indicator can be activated when the traveling object 206 has traveled for any portion of time of the target duration (e.g., midpoint of the target duration).

One of the many advantages of the timer 200 having the indicator 208 includes providing positive feedback to the user to promote compliance with proper hand washing. For example, the user may experience a positive reinforcement by seeing a light and/or hearing a sound (e.g., chime) transmitted by the indicator 208, signifying the user has washed their hands for the full target duration (e.g., 20 seconds).

While FIG. 2A illustrates the timer 200 including the first track 204, traveling object 206, mover 300, and indicator 208, the timer 200 can include one or more first tracks, one or more traveling objects, one or more movers, and/or one or more indicators. For example, the timer 200 may include two first tracks, two traveling objects, two movers, and/or two indicators.

Actuation (e.g., dispensing of soap) of the apparatus 100 can be coupled to the timer 200. In some embodiments, the timer 200 is coupled to the pump 103 and/or pump head 104. For example, displacement of the pump head 104 from a first pump head position (illustrated in solid lines in FIG. 1A) to a second pump head position (illustrated in dashed lines in FIG. 1A) displaces the mover 300 and the traveling object 206, from the first position 210*a* to the second position 210*b*. In this example, when the user presses down on the pump head 104 to dispense liquid soap, the timer 200 is activated.

The timer 200 can be coupled to the pump head 104 via mechanical mechanisms, electrical mechanism, magnetic mechanisms, or any combination thereof. In some embodiments, the timer 200 is coupled to the pump head 104 via mechanical means. For example, the mover 300 may include a pulley and/or a spring that is coupled to the pump head 104. In another example, the mover 300 may be displaced via air pressure, hydrostatic pressure, and/or any suitable pressure generated by displacing the pump head 104. The traveling object 206 may rest on the mover 300, such that displacing the mover 300 from the first position 210*a* to the second position 210*b* displaces the ball 206 in the same manner.

In some embodiments, the timer 200 is coupled to the pump head 104 via electrical and/or magnetic mechanisms. For example, the mover 300 may be displaced via a power source (e.g., a battery). In some embodiments, the traveling object 206 may be displaced from the first position 210*a* to the second position 210*b* without, or independently of, displacement of the mover 300 from the first position 210*a* to the second position 210*b*. In some embodiments, the traveling object 206 may be magnetic, and the mover 300 may be electromagnetic. To hold the traveling object 206 in a resting state, the electromagnetic mover 300 may have a polarity opposite to the polarity of the traveling object 206. To release the traveling object 206 from the stationary position, the electromagnetic mover 300 may switch the polarity to the same as the polarity of the traveling object 206, thereby repelling and displacing the traveling object 206.

Figure 2B:
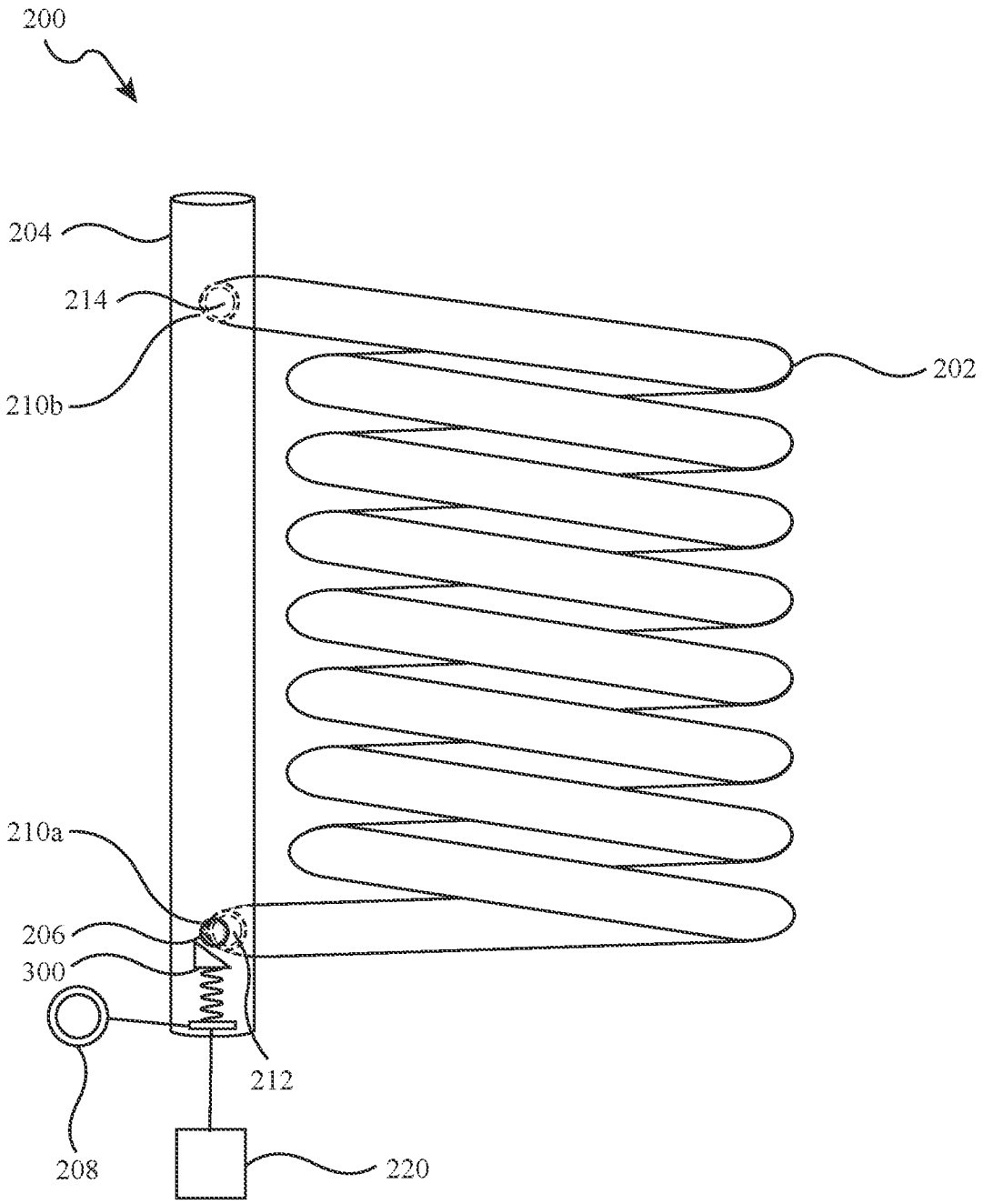

In some embodiments, the timer 200 includes one or more sensors. As illustrated in FIG. 2B, the timer 200 can include a sensor 220 (e.g., an infrared sensor), which can be coupled to the mover 300. For example, when the infrared sensor detects infrared energy (e.g., from a user's hand in proximity of the sensor), the mover 300 may begin to displace the traveling object 206. In some embodiments, the timer 200 is activated via only the one or more sensors, only the pump 103 and/or pump head 104, or any combination thereof.

While FIGS. 1A and 2 illustrate the timer 200 having the first track 202 with a single path, the timer 200 can include multiple paths. In some embodiments, the timer 200 can be configured similar to a pinball toy. For example, the timer 200 may include a maze in which the traveling object 206 travels through. For example, the traveling object 206 may fall via gravity through the maze along one or more random paths, and when the traveling object 206 reaches a bottom of the maze, the traveling object 206 returns to the mover 300.

Figure 3A:
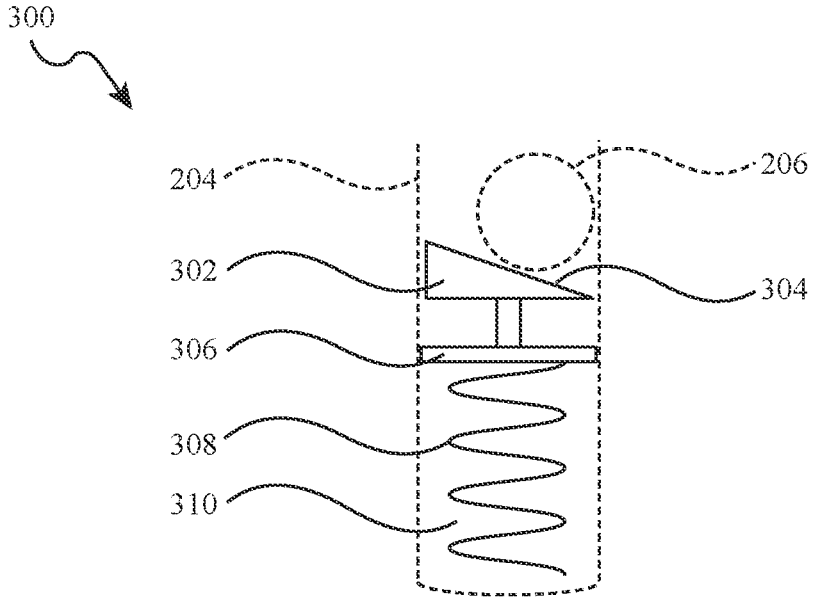
FIGS. 3A and 3B are front perspective views of a mover of the rolling ball timer configured in accordance with the present technology.
Figure 3B:
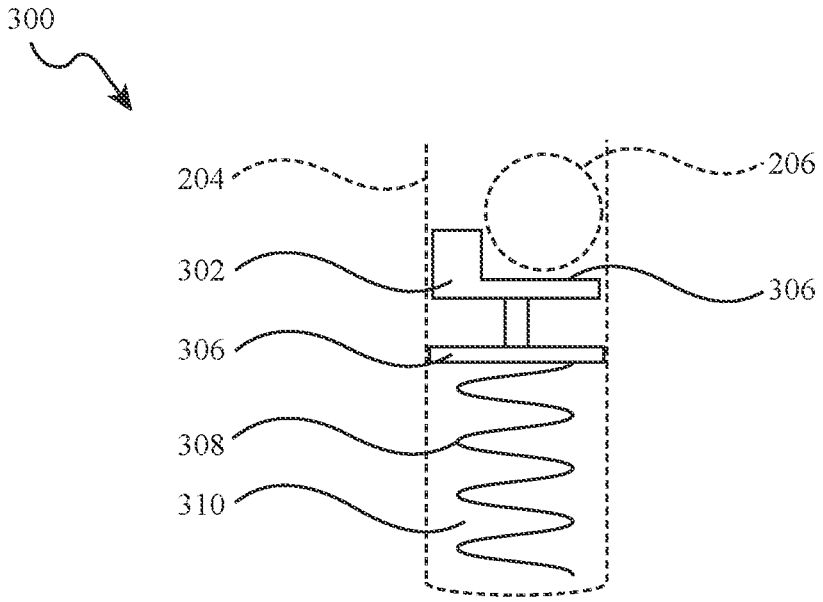

FIGS. 3A and 3B are front perspective views of the mover 300 configured in accordance with the present technology. In some embodiments, the mover 300 includes a holder 302, a piston 306, and a spring 308. The holder 302 may be fabricated of any suitable material such as plastic, wood, glass, metal, and/or rubber. The surface of a top side 304 of the holder 302 can contact the traveling object 206. Referring to FIG. 3A, the top side 304 can be configured to include an incline in the same direction (e.g., downward) as the first track 202. Referring to FIG. 3B, the top side 306 can be configured to include a step structure. In some embodiments, the top side 306 can have no incline. The incline and step of the top sides 304, 306 allows the traveling object 206 to be drawn towards the top opening 214 of the first track 202 via gravity. In some embodiments, the top sides 304, 306 can have no incline. In some embodiments, the top sides 304, 306 have a curved surface.

In some embodiments, the piston 306 can form an approximately airtight seal for the air chamber 310. The outer circumference of the piston 306 can be approximately equal to the inner circumference of the tunnel 204. The piston 306 may be fabricated of any suitable material such as plastic, wood, glass, metal, and/or rubber. In some embodiments, the spring 308 can have an outer circumference such that a distance between the outer circumference of the spring 308 and an inner circumference of the second track 204 is approximately less than the diameter of the traveling object 206; such configuration may prevent the traveling object 206 from prematurely entering the second track 204, such as before the holder 302 has returned to the first position 210*a* to receive the traveling object 206 via the bottom opening 212. The resting state of the spring 308 can position the holder 302 in the first position 210*a*.

In some embodiments, the pump head 104 can be coupled to the piston 306. For example, actuation of the pump head 104 can actuate the piston 306 via compression of air in the air chamber 310. The piston 306 displaces the holder 302 from the first position 210*a* to the second position 210*b* via decompression of the air in the air chamber 310; this displacement may elongate the spring. Subsequently, tension on the spring 308 may return the spring 308 to its resting state and displace the holder 302 back to the first position 210*a*. While the mover 300 is shown to include one piston 306 and one spring 308 in FIGS. 3A and 3B, the mover 300 can include one or more pistons and one or more springs.

In some embodiments, the mover 300 may include only the holder 302. In some embodiments, the mover 300 may include the holder 302 and the piston 306 or spring 308. For example, the mover 300 can include the holder 302 and spring 308. In some embodiments, the pump head 104 can be coupled to the spring 308. For example, actuating the pump head 104 can actuate (e.g., decompress) the spring 308 to displace the traveling object 206 from the first position 210*a* to the second position 210*b*.

In some embodiments, the mover 300 may include a manual component. The manual component may include a lever and a spring. The user can manually displace the mover 300 and the traveling object 206 by manually moving the lever from the first position 210*a* to the second position 210*b*. The spring recoils the mover 300 back to the first position 210*a* upon the user's release of the lever.

Figure 4A:
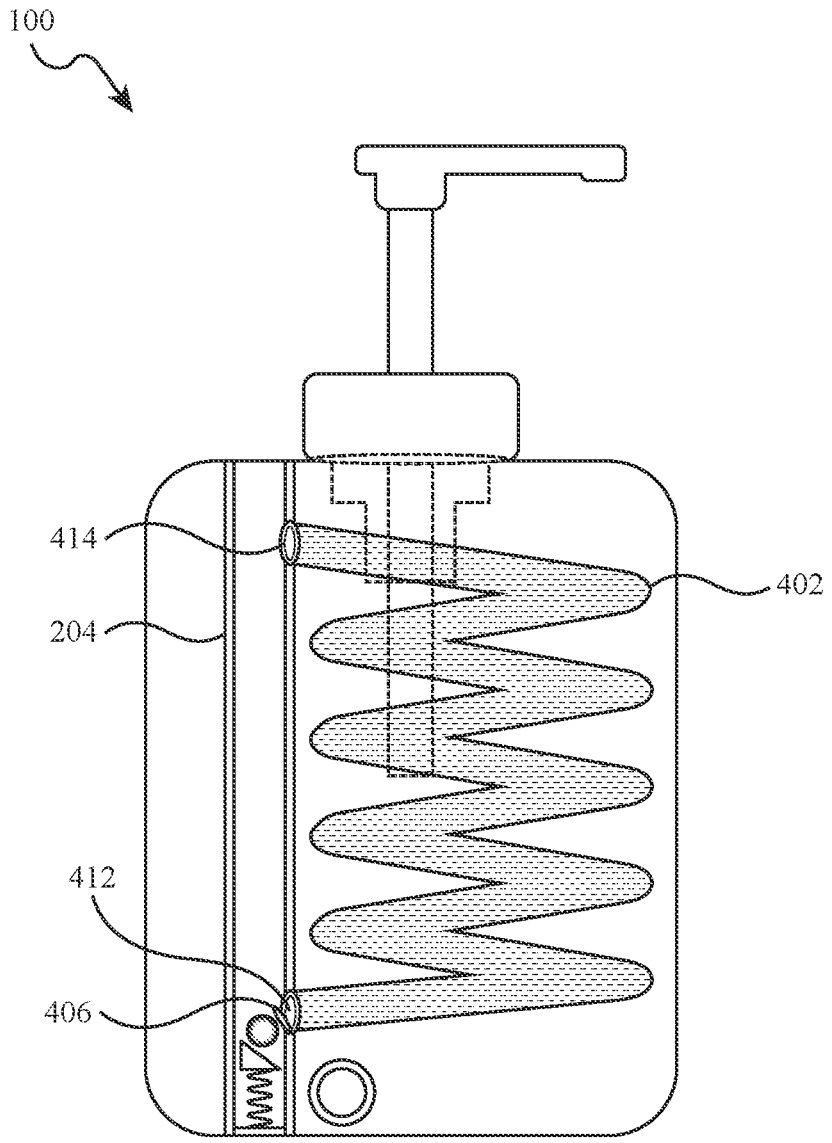
FIGS. 4A and 4B is a front perspective view and cross-sectional view, respectively, of the liquid hand soap dispenser configured in accordance with select embodiments of the present technology.
Figure 4B:
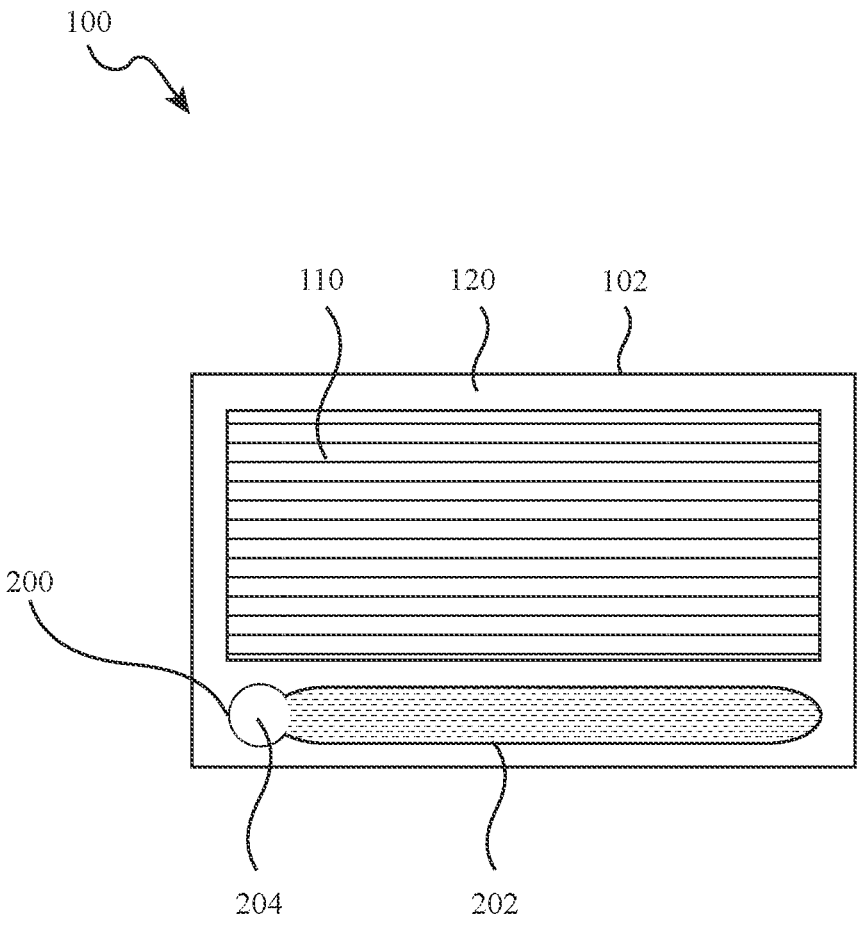

FIGS. 4A and 4B is a front perspective view and cross-sectional view, respectively, of the dispenser 10 configured in accordance with select embodiments of the present technology. The dispenser 10 includes a timer 400. The timer 400 can include features generally similar to or the same as the timer 200, except that the timer 400 includes a first track 402 configured with a zig-zag layout. The first track 402 includes a bottom opening 412 and a top opening 414. The timer 400 can include a bottom flap 406 located at the bottom opening 412. The bottom flap 406 can be displaced to block the traveling object 206 from re-entering the first track 402 via the bottom opening 412. Referring to FIG. 4B, the timer 400 can be located on one or more sides of the dispenser 10. While the cross section of the external housing 102 and internal housing 120 is shown to be rectangular in FIG. 4B, the external housing 102 and internal housing 120 can have other cross-sectional shapes (e.g., circular, elliptical, oval, oblong, rectilinear, square, irregular, diamond, trapezoidal, or any combination thereof).

Figure 5:
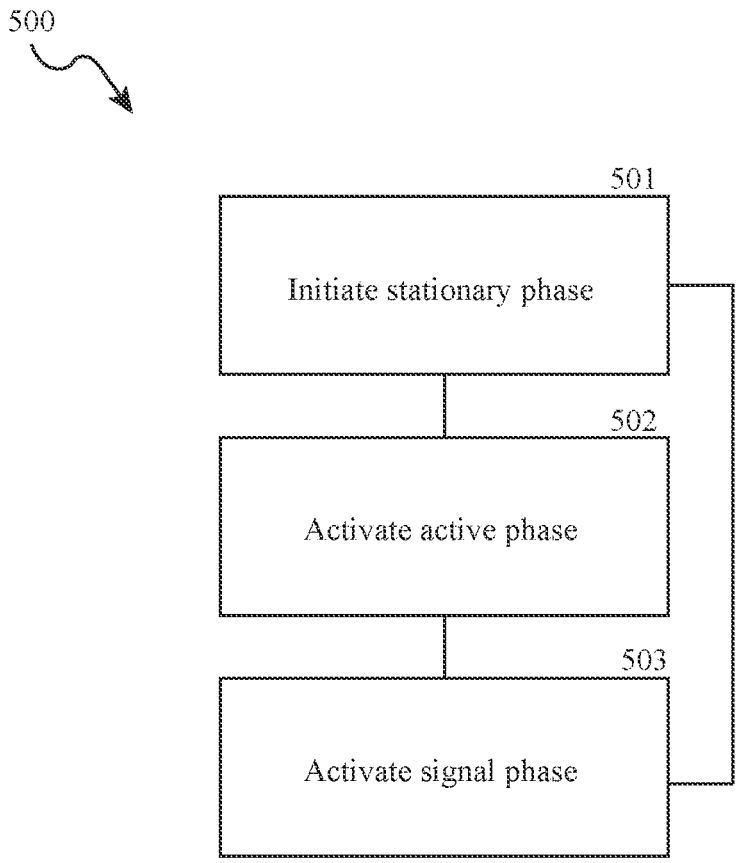
FIG. 5 is a flow diagram illustrating a method of operating the liquid hand soap dispenser in accordance with the present technology.

FIG. 5 is a flow diagram illustrating a method 500 of operating the liquid soap dispenser in accordance with the present technology. In block 501, the method 500 initiates a stationary phase. The traveling object is resting on the mover in the second track, and the mover is in the stationary position. In the illustrated embodiments, the stationary position is located proximate to the bottom opening. In other embodiments, the stationary position may be located at a middle portion of the second track between the top and bottom opening. In other embodiments, the stationary position may be located proximate to the top opening. Block 502 is activated when a user activates the dispenser. For example, for a manual liquid soap dispenser, the user can activate the dispenser by manually pressing the pump head of the soap dispensing apparatus. In another example, for an automatic liquid soap dispenser, the user can activate the soap dispensing apparatus by placing their hands proximate to a sensor (e.g., infrared sensor) of the dispenser. In block 502, the method 500 activates the active phase. The mover displaces the traveling object in an approximately vertically upward direction through the second track to a position proximate to a top opening and releases the traveling object into the first rack. The traveling object moves along the first track. The mover returns to the first position to receive the traveling object upon the traveling object exiting the first track. In block 503, the method 500 activates the signal phase. Upon the traveling object exiting the first track and being received by the mover, the indicator transmits a signal. The method 500 returns to block 501.

Figure 6:
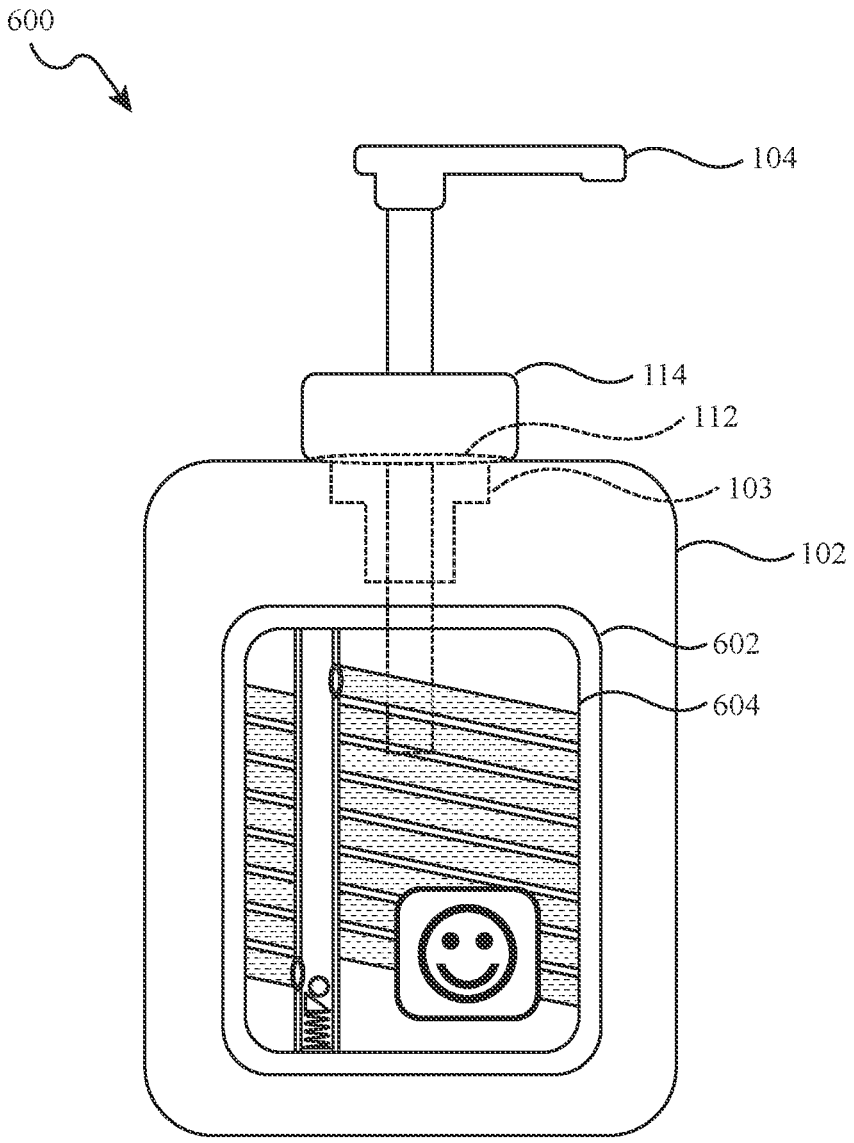
FIG. 6 is a front perspective view of a liquid hand soap dispenser configured in accordance with select embodiments of the present technology.

FIG. 6 is a front perspective view of a hand soap dispenser ("dispenser 600") configured in accordance with select embodiments of the present technology The dispenser 600 can be generally similar to or the same as the dispenser 10. For example, the dispenser 600 can include the external housing 102, pump 103, pump head 104, first reservoir opening 112, and closure 114. The dispenser 600 can include a digital timer 602. The pump head 104 can be coupled to the digital timer 602. The digital timer 602 can include components generally similar to or the same as components of conventional digital timers. The digital timer 602 can include a display 604. The display 604 can show a visual indication of time. For example, the display 604 can show a video of a traveling object moving through a track (e.g., a ball rolling through a tube and/or a ball falling through a maze). In some embodiments, the digital timer 602 can include a counter. The counter may be set to the approximate predetermined duration (e.g., 30 seconds). At the beginning of the duration, the display 604 may display a start screen. For example, the start screen can include a drawing, picture, and/or message (e.g., "Begin!"). After the beginning and before the end of the duration, the display 604 may display a middle screen. For example, the middle screen can include a drawing, picture, and/or message (e.g., "Almost there!"). At the end of the duration, the display 604 may display an end screen. For example, the end screen can include a drawing, picture (e.g., smiley face), and/or message (e.g., "Finished!").

As one skilled in the art will appreciate from the forgoing disclosure, various modifications to the described embodiments can be made without deviating from the scope of the present technology. For example, many of the components described with respect to a particular embodiment can be incorporated into or used with various components described with respect to a different embodiment. Moreover, certain features can be omitted from, or added to, the described embodiments without deviating from the scope of the present technology. Likewise, although steps are presented in a given order, alternative embodiments may perform steps in a different order. Accordingly, the present technology is not limited to the embodiments specifically identified herein.

From the foregoing, it will be appreciated that specific embodiments of the technology have been described herein for purposes of illustration, but well-known structures and functions have not been shown or described in detail to avoid unnecessarily obscuring the description of the embodiments of the technology. Where the context permits, singular or plural terms may also include the plural or singular term, respectively.

Unless the context clearly requires otherwise, throughout the description and the claims, the words "comprise," "comprising," and the life are to be construed in an inclusive sense, as opposed to an exclusive or exhaustive sense; that is to say, in the sense of "including, but not limited to." As used herein, the terms "connected," "coupled," or any variant thereof, means any connections or coupling, either direct or indirect, between two or more elements; the coupling of connection between the elements can be physical, logical, or a combination thereof. Additionally, the words "herein," "above," "below," and words of similar import, when used in this application, shall refer to this application as a whole and not to any particular portions of this application. Where the context permits, words in the above Detailed Description using the singular or plural number may also include the plural or singular number respectively. As used herein, the phrase "and/or" as in "A and/or B" refers to A alone, B alone, and A and B.

Where a range of values is provided, it is understood that each intervening value, to the tenth of the unit of the lower limit unless the context clearly dictates otherwise, to between the upper and lower limits of that range is also specifically disclosed. Each smaller range between any stated value or intervening value in a stated range and any other stated or intervening value in that stated range is encompassed within the disclosure. The upper and lower limits of these smaller ranges may independently be included or excluded in the range, and each range where either, neither, or both limits are included in the smaller ranges is also encompassed within the disclosure, subject to any specifically excluded limit in the stated range. Where the stated range includes one or both of the limits, ranges excluding either or both of those included limits are also included in the disclosure.

It will also be appreciated that specific embodiments have been described herein for purposes of illustration, but that various modifications may be made without deviating from the technology. Further, while advantages associated with some embodiments of the technology have been described in the context of those embodiments, other embodiments may also exhibit such advantages, and not all embodiments need necessarily exhibit such advantages to fall within the scope of the technology. Accordingly, the disclosure and associated technology can encompass other embodiments not expressly shown or described herein.

I claim:

1. A soap dispensing device, comprising:
- a soap dispensing apparatus including—
  - a housing, and
  - a soap dispensing element,
- a timer including—
  - a traveling object,
  - a track configured to receive the traveling object at a start position and release the traveling object at an end position and to carry the traveling object from the start position to the end position in a time interval, and
  - a mover configured to displace the traveling object from a first position to a second position, wherein displacement of the traveling object from the first position to the second position initiates the release of the traveling object onto the track at the start position.

2. The soap dispensing device of claim 1, wherein the soap dispensing apparatus is configured to dispense soap manually.

3. The soap dispensing device of claim 1, wherein the soap dispensing element includes at least a pump head and a pump.

4. The soap dispensing device of claim 1, wherein the soap dispensing apparatus is configured to dispense soap automatically.

5. The soap dispensing device of claim 1, wherein the soap dispensing element includes an infrared sensor.

6. The soap dispensing device of claim 1, wherein the traveling object includes a ball.

7. The soap dispensing device of claim 1, wherein the traveling object includes a wheel and/or a block.

8. The soap dispensing device of claim 1, wherein the mover is coupled to the soap dispensing element.

9. The soap dispensing device of claim 1, wherein the mover includes at least a holder, a piston, a spring, a magnet, and an electromagnet.

10. The soap dispensing device of claim 1, wherein the timer includes an infrared sensor coupled to the mover.

11. The soap dispensing device of claim 1, wherein the track includes a tube.

12. The soap dispensing device of claim 1, wherein the track includes two rails running along a length of the track.

13. The soap dispensing device of claim 1, wherein the timer includes an indicator, wherein the indicator transmits a visual signal, an audio signal, a vibratory signal, or any combination thereof.

14. A soap dispensing device, comprising:

a soap dispensing apparatus including— a housing, and a soap dispensing element, a timer including— a traveling object, a track configured to receive the traveling object at a start position and release the traveling object at an end position and to carry the traveling object from the start position to the end position in a time interval, and a mover configured to displace the traveling object from a first position to a second position, wherein displacement of the traveling object from the first position to the second position initiates the release of the traveling object onto the track at the start position, and wherein the mover is coupled to the soap dispensing element.

15. The soap dispensing device of claim 14, wherein the soap dispensing element includes a pump head.

16. The soap dispensing device of claim 15, wherein the mover is coupled to the pump head.

17. The soap dispensing device of claim 14, wherein the soap dispensing element includes a sensor.

18. The soap dispensing device of claim 17, wherein the mover is coupled to the sensor.

19. The soap dispensing device of claim 17, wherein the sensor is an infrared sensor.

20. A soap dispensing device, comprising:

a soap dispensing apparatus including— a housing, and a soap dispensing element, a timer including— a ball, a track configured to: a) receive the ball at a start position and release the ball at an end position and b) carry the ball from the start position to the end position in a time interval, and a mover configured to displace the ball from a first position to a second position, wherein displacement of the ball from the first position to the second position initiates the release of the ball onto the track at the start position, and wherein the mover is coupled to the soap dispensing element.

* * * * *